US005785211A

United States Patent [19]

Tieskoetter

[11] Patent Number: 5,785,211

[45] Date of Patent: Jul. 28, 1998

[54] PORTABLE POWERED BEER KEG TAPPING DEVICE WITH AIR PRESSURE REGULATOR

[75] Inventor: Mark Tieskoetter, Dubuque, Iowa

[73] Assignee: ABD, L.C., Dubuque, Iowa

[21] Appl. No.: 772,339

[22] Filed: Dec. 23, 1996

[51] Int. Cl.[6] ..... B65D 83/00

[52] U.S. Cl. ..... 222/396; 222/400.8; 222/401

[58] Field of Search ..... 222/61, 153.11, 222/333, 394, 396, 399, 400.7, 400.8, 401

[56] References Cited

U.S. PATENT DOCUMENTS

| | | | |
|---|---|---|---|
| 2,081,159 | 5/1937 | Tamminga et al. | 226/116 |
| 2,638,758 | 5/1953 | Daun | 62/141 |
| 3,825,154 | 7/1974 | Jaeger | 222/136 |
| 4,002,273 | 1/1977 | Golding et al. | 222/400.7 |
| 4,030,634 | 6/1977 | Osborn | 222/23 |
| 4,070,133 | 1/1978 | McCormick | 417/38 |
| 4,153,181 | 5/1979 | Parker et al. | 222/61 |
| 4,174,743 | 11/1979 | Beny et al. | 141/18 |
| 4,180,189 | 12/1979 | Zurit et al. | 222/400.7 |
| 4,228,927 | 10/1980 | Beyens et al. | 222/148 |
| 4,260,074 | 4/1981 | Cerrato | 222/1 |
| 4,350,270 | 9/1982 | Nezworski | 222/336 |
| 4,406,301 | 9/1983 | Cerrato | 137/212 |
| 4,418,848 | 12/1983 | Lunau | 222/504 |
| 4,516,698 | 5/1985 | Cerrato | 222/341 |
| 4,728,010 | 3/1988 | Johnston | 222/397 |
| 4,860,931 | 8/1989 | Hubbard | 222/400.8 |
| 4,921,135 | 5/1990 | Pleet | 222/396 |
| 4,997,111 | 3/1991 | Lowers | 222/399 |
| 5,129,552 | 7/1992 | Painchaud et al. | 222/399 |
| 5,248,062 | 9/1993 | Hillard | 222/81 |
| 5,540,355 | 7/1996 | Hancock et al. | 222/56 |
| 5,641,094 | 6/1997 | Wunsch | 222/400.8 |
| 5,699,940 | 12/1997 | Clark, II | 222/394 |

*Primary Examiner*—Joseph Kaufman
*Attorney, Agent, or Firm*—Allan L. Harms

[57] ABSTRACT

A portable, electrically powered keg tapping device for beer kegs has a valve body including a liquid passageway open to the bottom of the valve body and to a liquid dispensing port on the body and an air passageway open at the bottom of the valve body laterally spaced from the liquid passageway and coupled to the output of an AC or DC powered air pump which is controlled by a pressure regulator. In an alternative embodiment, a pumping assembly is provided with an adapter plate which can be used to convert a manually operated keg tapping apparatus to a powered, pressure-regulated tapping apparatus.

20 Claims, 4 Drawing Sheets

PORTABLE POWERED BEER KEG TAPPING DEVICE WITH AIR PRESSURE REGULATOR

BACKGROUND OF THE INVENTION

This invention pertains to keg tapping valves used with beer kegs. The traditional keg tapping valve includes a descending probe which selectively opens the closure valve of a beer keg. A hand pump associated with the probe is used to force air into the keg. A manually operated valve is used to control the flow of beer through the probe when the keg is pressurized sufficiently to force beer to flow from the keg. A bayonet apparatus which mates with the keg's opening allows the probe to be installed on the keg without escape of beer from the keg. Such an apparatus is described in U.S. Pat. No. 4,180,189 to Zurit et al.

The present keg tapping devices depend on hand pumping to pressurize the keg and cause beer to be forced from the valve. This results in interruption in the dispensing of beer when the pressure within the keg drops and hand pumping must be commenced. Further, the hand pumping may result in over pressure conditions within the keg, thereby causing the beer to be dispensed in an excessively aerated state, that is, foamy.

SUMMARY OF THE INVENTION

The present invention provides a portable powered keg tapping device for beer kegs. The keg tapping device may be electrically powered by AC or DC power and is provided with a pressure regulating control valve which selectively controls operation of an electrically powered air pump to maintain a selected pressure within the keg. The tapping device includes a valve structure on which a pumping apparatus is mounted. The valve structure includes a bayonet mounting which will mate to the bayonet fitting of a beer keg having a spring-loaded valve below the bayonet fitting and a down tube within the keg. The valve includes a liquid passageway vertically extending through the valve and communicative with a side port which can be connected to a dispensing hose terminated with a manually operated valve. An air passageway extends vertically through the valve and is isolated from the liquid passageway and its lower opening is spaced apart from the opening of the liquid passageway, such that beer will not flow through the air passageway. The upper terminus of the air passageway is a nipple extending from the valve and into the pumping member where a duct interconnects the nipple to an air pump powered by a 12 VDC motor. A pressure regulator senses the pressure in the air duct and interrupts electricity to the motor when a preset pressure, nominally six psi is reached. The pumping member may be powered by a battery pack, by a car battery through a cigarette lighter socket, or by an AC/DC converter which can transform 110 VAC or another voltage to a 12 VDC output. The pumping member is provided with a plug mounted thereon which is matable with a socket from a DC electrical source.

An alternative embodiment provides pumping apparatus which may be installed on manually operated keg tapping apparatus equipped with a reciprocating hand pump which is disposed vertically above the keg tapping valve apparatus. Such devices may be easily converted to powered apparatus by removal of the top mounted hand pump followed by installation in its place of a top plate having a nipple mounted on it which has a passageway which will align with the air passageway of the valve to which the previously installed hand pump was attached. The pumping apparatus of the present invention comprising the DC motor, air pump, pressure regulator and ducts may be then interconnected to the nipple of the replacement top plate.

It is an object of the invention to provide a keg tapping device which maintains a relatively constant pressure within the keg.

It is another object of the invention to provide a keg tapping device which pressurizes the keg to cause beer to flow from the keg without manual efforts on the part of the user.

It is a further object of the invention to provide a portable powered beer keg tapping apparatus.

It is a further object of the invention to provide a powered beer keg tapping device which may be operated by a battery.

It is a further object of the invention to provide a powered beer keg tapping device which may be powered by either a battery or an AC power source.

Other objects, features and advantages of the invention will be apparent from review of the ensuing description.

DESCRIPTION OF THE DRAWING FIGURES

DETAILED DESCRIPTION OF THE INVENTION

Figure 1:
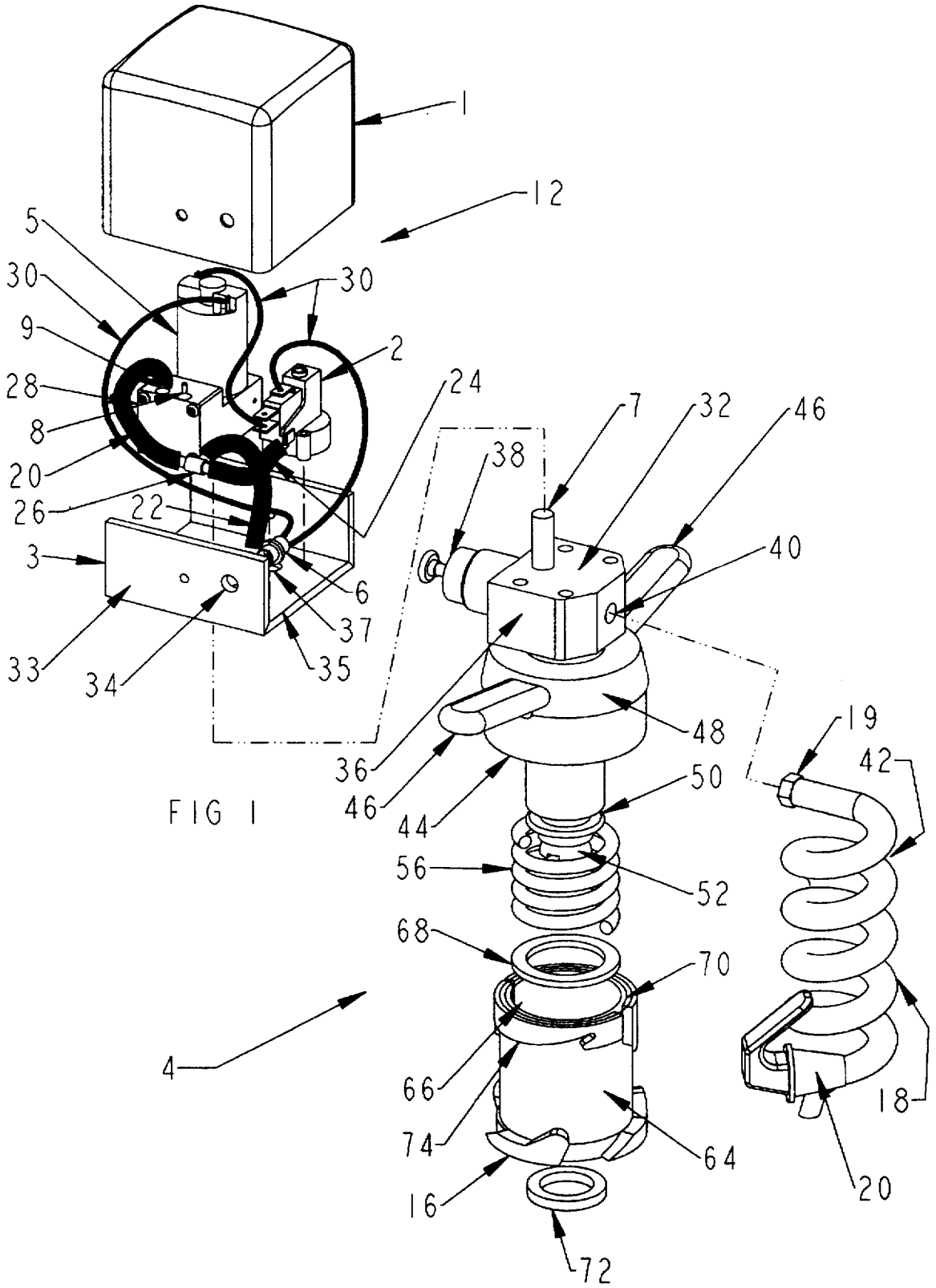
FIG. 1 is an exploded perspective view of the beer keg tapping apparatus of the invention.

FIG. 1 discloses the invention in an exploded perspective view. The invention 10 is characterized by a combination of a powered pumping assembly 12 and a keg tapping valve 4. Keg tapping valve 4 includes a bayonet mount 16 for selective complementary mounting to a keg fitting of a beer keg. The keg fitting is provided with a spring loaded valve which must be depressed to open communication with the interior of the keg. Such connections are commonly used for fastening probe fittings to keg openings and are well known in the art.

The keg tapping valve 4 further includes a dispensing hose 18, terminating in a manually operated dispensing valve 20 of the commonly used variety, the dispensing hose 18 being communicative with the down tube of the keg to permit beer to pass therethrough when keg tapping valve 4 is installed on the keg and dispensing valve 20 is opened. A nipple 7 is provided upon top 32 of beer keg tapping valve 4 through which air may be passed through an air passageway 60 within beer keg tapping valve 4 to the interior of the keg to which beer keg tapping valve 4 is attached.

Pumping assembly 12 comprises an electric motor 5, an air pump 28 driveable by motor 5, operatively connected to a pressure regulator 2. The pump assembly 12 is enclosable within a close fitting unitary shroud 1 of pleasing shape which overlies base 3 and protects motor 5, pump 28 and pressure regulator 2 from liquids or other contaminants.

Base 3 is fixed by adhesive or other suitable means to top 32 of keg tapping valve 4. Atmospheric air is drawn into air pump 28 at port 8 where it is compressed and transmitted out port 9 and along first tube 20 and second tube 22 to nipple 7. A T-connector 26 is placed in series with first tube 20 and second tube 22 to allow connection of third tube 24 therewith such that the passageways within each of tubes 20, 22, and 24 are intercommunicative. Third tube 24 interconnects T-connector 26 to pressure regulator 2 which detects air pressure levels in tubes 20, 22, 24 and is preset to selectively interrupt electric power to motor 5 when a selected pressure exists in tubes 20, 22, 24, it being determined that 4±2 psi is the desired range of pressure within the keg to adequately cause flow of liquid beer through dispensing hose 18 without causing foaming of the dispensed beer. In the preferred embodiment, tubes 20, 22 and 24 are of flexible synthetic hose.

Air pump 28 is chosen to be capable of delivering two liters of air per minute at 4±2 psi. Motor 5 is selected to preferably be a 12 VDC motor such that it may be powered by battery means or by AC/DC converter means. Pressure regulator 2 is chosen such that when air pressure within air tubes 20, 22, and 24 reaches 6 psi, the electric power to motor 5 is interrupted and motor 5 stops driving pump 28.

Figure 3:
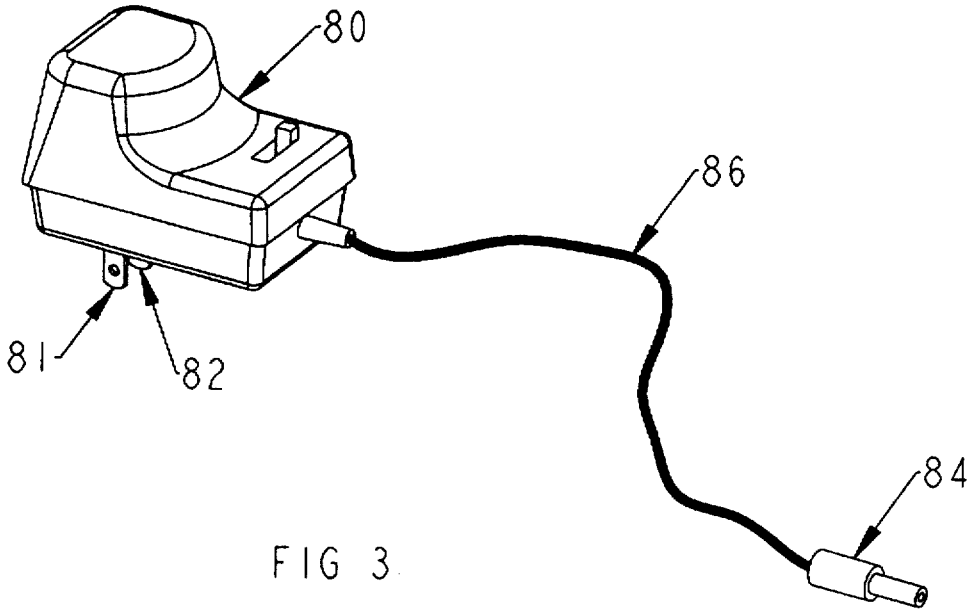
FIG. 3 is a perspective view of a 110 VAC power supply which may be used to power the invention.
Figure 4:
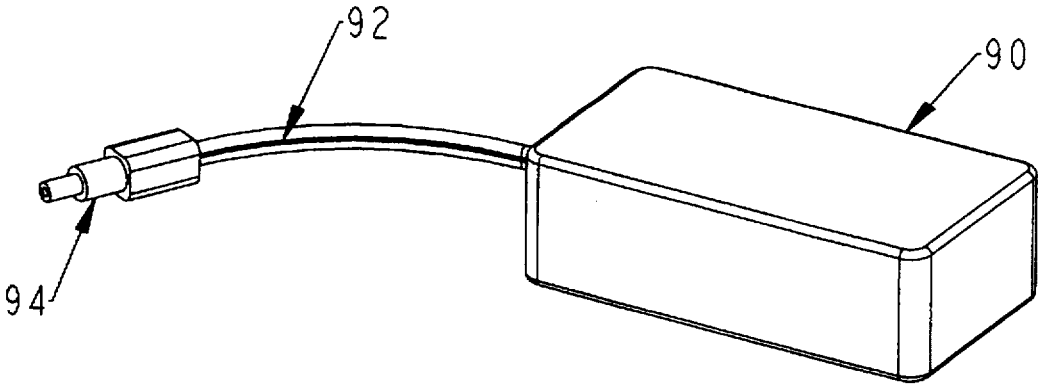
FIG. 4 is a perspective view of a battery pack power supply which may be used to power the invention.

Electricity for activation of motor 5 is provided by wiring 30 which electrically couples motor 5 to pressure regulator 2 and to electric plug 6, each being in series with the others. Electric plug 6 is selected to receive the mating socket associated with a 12 VDC power supply such as a 110 VAC to 12 VDC transformer-rectifier as shown in FIG. 3 or a socket which may be coupled to a 12 VDC battery source such as a car battery or a self contained battery pack such as battery pack 90 shown in FIG. 4. It is contemplated that a car cigarette lighter socket may be employed with an appropriate cable to provide 12 VDC from the car battery to plug 6. It should be understood that motor 5 may be substituted by a motor capable of operation from an AC voltage source if a battery power option is not desired.

In the preferred embodiment, base 3 includes a front wall 33 having opening 34 therein wherein plug 6 may be mounted, such that plug 6 is accessible without removal of shroud 1 for selective attachment therewith to 12 VDC electrical sources. Floor 35 of base 3 includes aperture 37 through which nipple 7 of valve assembly 4 may extend for coupling to duct 22.

Figure 2:
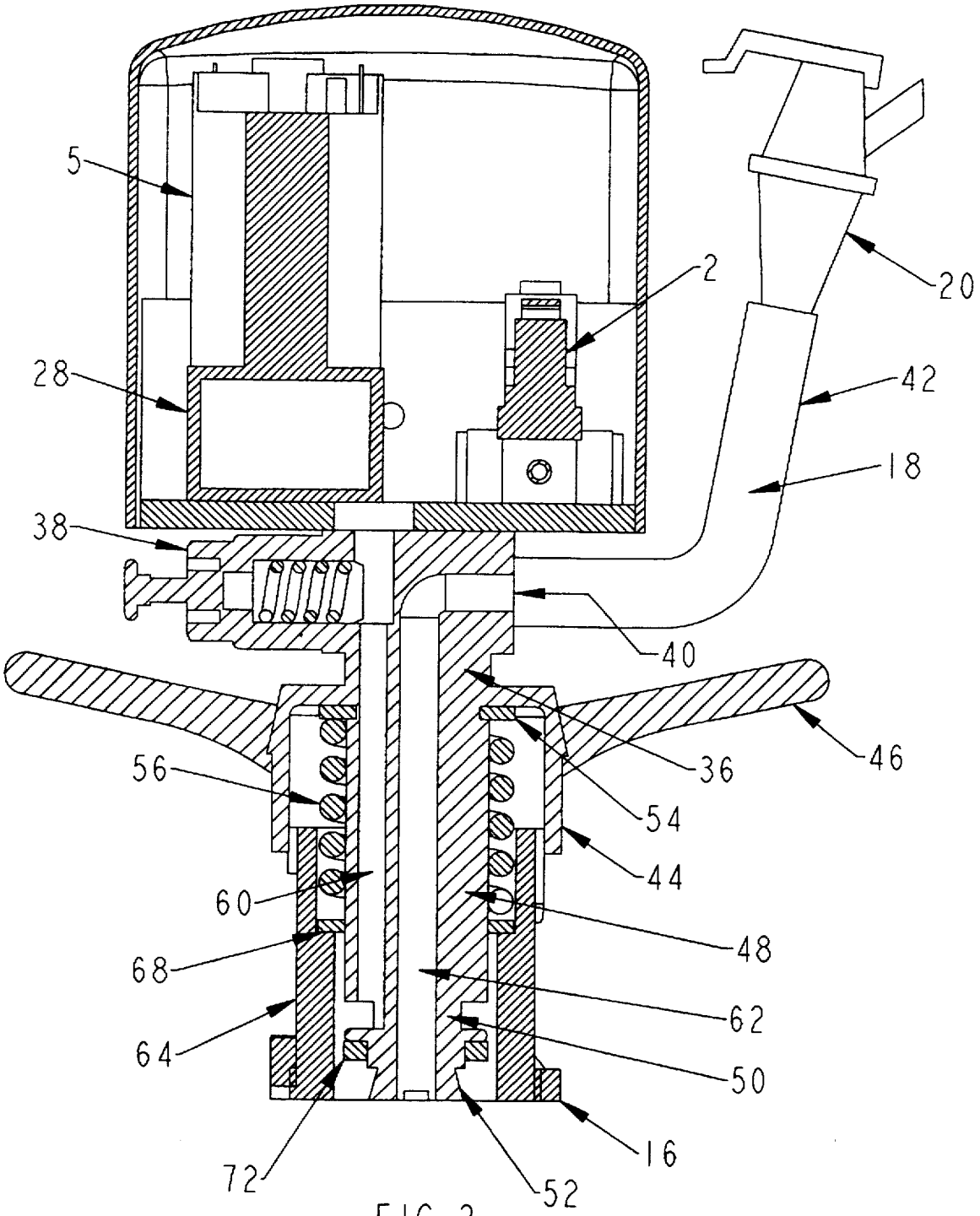
FIG. 2 is a vertical sectional view of the invention.

Reference is directed to FIGS. 1 and 2. Valve 4 comprises an elongate probe body 48 having a distribution head 36 at its upper end. Distribution head 36 includes relief valve assembly 38 which is coupled to air passageway 60 within body 48. Distribution head 36 also includes port 40 which is communicative with the liquid passageway 62 of body 48 and is conveniently mounted on the side of distribution head 36. Port 40 may be coupled to fitting 19 of dispenser assembly 42. Dispenser assembly includes dispensing hose 18 and dispensing valve 20.

Lower end 50 of probe body 48 is provided with keg valve probe foot 52 which engages the spring loaded valve of a keg to which invention 10 is mounted.

Annularly surrounding probe body 48 along a segment of its length is hub 44. Hub 44 is provided with diametrically opposing handles 46 which extend from hub 44 to provide means to manually rotate valve 4 as it is engaged with the bayonet fitting of the keg to be tapped. Annular shoulder element 54 is vertically fixed upon probe body 48 such that hub 44 may impose downward forces on shoulder element 54.

Probe housing 64 coaxially surrounds the lower end of probe body 48 and is provided at its lower end with keg bayonet mount 16. A cup 66 is counterbored within upper end 70 of probe housing 64 and receives ring 68. Lower end of coil spring 56 bears on ring 68. As hub 44 is rotated, a cam follower within hub 44 follows cam 74 of probe housing 64 causing hub 44 to further overlap probe housing 64 and thereby exerting compression forces on coil spring 56 which helically surrounds probe body 48. Washer 72 isolates the liquid passageway 62 from the air passageway 60 of probe body 48.

It may be understood that invention 10 may be mounted to a bayonet fitting equipped beer keg. The clockwise rotation of hub 44 locks bayonet mount 16 to the keg. Further clockwise rotation of hub 44 forces probe body 48 downward against the resistance of coil spring 56 such that probe foot 52 depresses the valve within the keg. A 12 VDC power source is applied to plug 6 and motor 5 begins to operate to compress air by pump 28 into passageway. Motor 5 continues to operate until approximately 6 psi is exceeded in ducts 20, 22, and 24 whereupon pressure regulator 2 disconnects electric power to motor 5. As beer is dispensed from the keg, the pressure within the passageway 60 declines causing pressure regulator to sense lower air pressure in ducts 20, 22, and 24 and to react by closing the electric circuit to motor 5.

Figure 5:
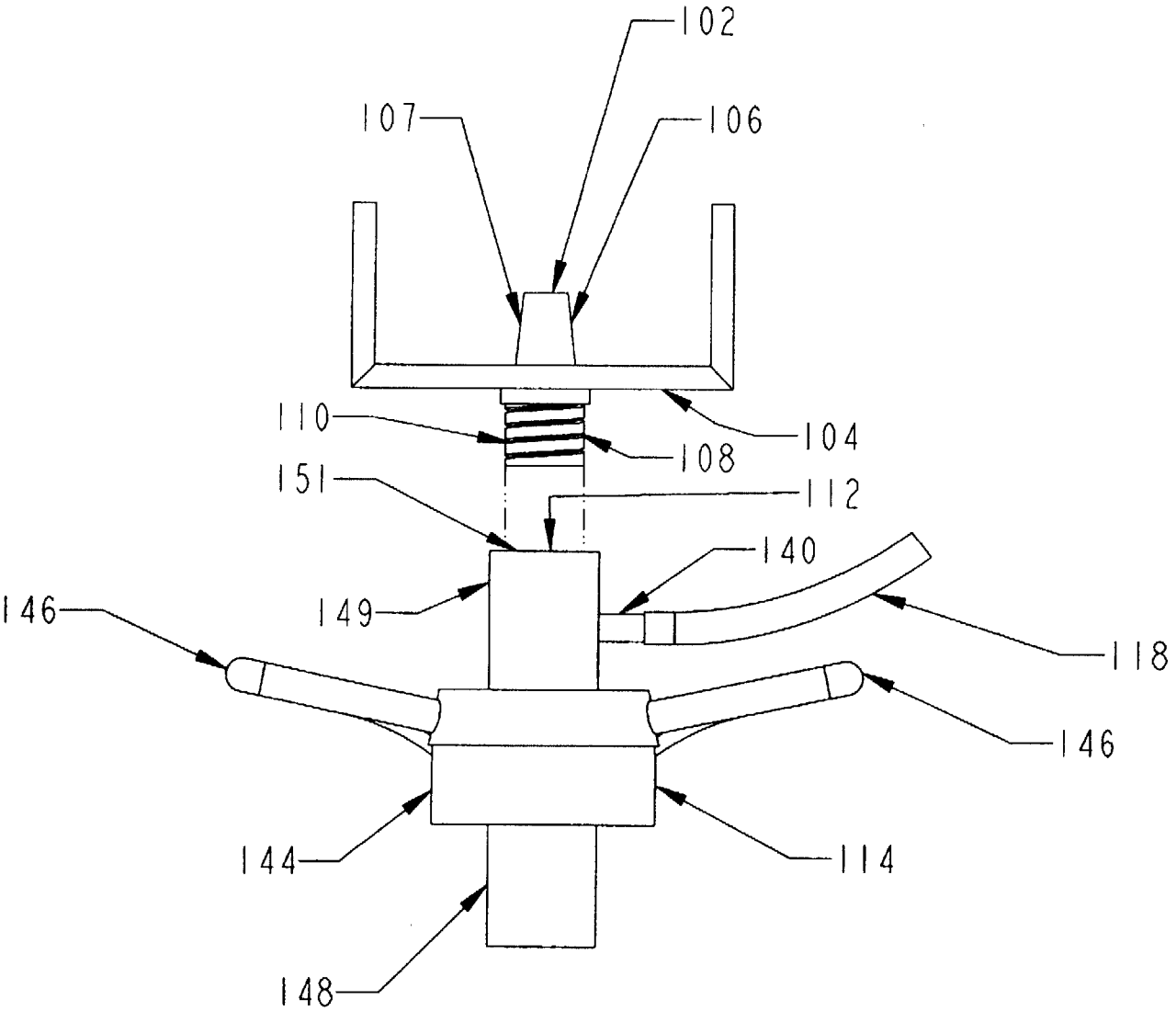
FIG. 5 is a front elevation exploded view of an alternative keg tapping valve with an associated adapter mounted thereon for use with the pumping assembly of the invention in a retrofit application.

In an alternate embodiment, powered pumping assembly 12 may be provided as part of a retrofit kit for existing keg tapping devices which are provided with top mounted hand pump apparatus, typically of the reciprocating type. In such existing keg tapping devices, the existing hand pump apparatus is mounted to the top of the valve such as keg tapping valve 114 of FIG. 5. Keg tapping valve 114 is substantially similar to valve 4 of FIGS. 1 and 2 except no distribution head is provided for keg tapping valve 114. A collar 144 surrounds body 148 and is provided with handles 146 which are useful to rotate collar 144 which causes body 148 to rotate as it is mounted to the bayonet fitting of a beer keg having a down tube coaxial with the bayonet fitting thereof. After being fixed to the keg's bayonet mount, the collar 144 is further rotated to force body 148 downward against a spring loaded valve above the down tube of the keg. Keg tapping valve 114 is provided with a liquid passageway therethrough which terminates at its upper end in spout 140 to which a dispensing hose 118 may be attached. Keg tapping valve 114 is also provided with an internal air passageway therethrough which is isolated from the liquid passageway therethrough. The upper end of the air passageway terminates in a counterbore 112 within upper end 149 of body 148. Counterbore 112 is provided with internal threading from which the preexisting hand pump apparatus has been removed. With the existing hand pump apparatus removed, the upper end of the air passageway would be exposed within counterbore 112. A top plate 104 is provided with nipple 106 mounted therein, nipple 106 having therethrough an axial passageway 102. Nipple 106 includes a threaded fitting 108 having external threads 110 thereon. Threads 110 are matable with the internal threading of counterbore 112 of upper end 149 of body 148 such that top plate 104 may then be mounted to the top 151 of the valve member 114 in place of the previously-removed hand pump apparatus. The passageway 102 through nipple 106 is intercommunicative with the air passageway within body 148. Second tube 22 of pump assembly 12 as illustrated in FIGS. 1 and 2 would then interconnect to the upper end 107 of nipple 106.

The preferred embodiment has been illustrated and described but changes may be made to the precise structure without departing from the invention as described in the following claims.

Having described the invention, I claim:

1. In combination, a beer keg tapping valve matable with a keg having a bayonet fitting and having a down tube therein with a spring biased valve opening into the down tube of the keg, and a pumping assembly operative with said beer keg tapping valve, the beer keg tapping valve further comprising a body having an air passageway therethrough and a liquid passageway therethrough isolated from said air passageway, said liquid passageway communicative with the opening of said keg down tube when said beer keg tapping valve is operatively coupled with said keg fitting, said body having a nipple mounted thereon, said nipple communicative with said air passageway, said pumping assembly comprising an electric motor, an air pump, and a pressure regulator, the air pump having an output port coupled to said nipple of said body by a first duct, the pressure regulator coupled to said output port of said air pump by a second duct, said pressure regulator operative to sense air pressure in said second duct, said pressure regulator electrically coupled to said motor, said motor electrically coupled to a source of electric power, said pressure regulator preset to interrupt said electric coupling of said motor to said electric source as long as a predetermined air pressure in said second duct is present.

2. The combination of claim 1 wherein said motor is a 12 VDC motor.

3. The combination of claim 2 wherein said motor is electrically coupled to a plug mounted on the exterior of said pumping assembly.

4. The combination of claim 3 wherein said plug is selectively coupled to a 110 VAC to 12 VDC converter or to a twelve volt battery pack.

5. The combination of claim 1 wherein said output port of said air pump is coupled to a T-connector, said pressure regulator is coupled to said T-connector, said nipple is coupled to said T-connector.

6. The combination of claim 5 wherein said air pump delivers at least one liter of air per minute at 4±2 pounds per square inch.

7. The combination of claim 1 wherein said pressure regulator selectively interrupts said electric coupling between said motor and said source of electric power whenever pressure in said ducts exceeds approximately 6 psi.

8. A keg pump assembly for removable attachment to a keg for pressurized delivery of beer or other beverage within the keg, comprising a generally annular body having a keg-engagable flanged lower end and a cylindrical bore extending upwardly from said lower end, an elongate probe having a cylindrical lower portion in longitudinally and rotatably displaceable sealed relation to said bore and extending upward beyond the upper end of said body, said probe having a first internal passage communicating between the lower end of the probe and an outwardly directed beverage-dispensing port at a location upon said body, said probe having a second internal passage communicating between the upper end of the probe and open at the lower end of the probe at a location offset from the lower end of the first passage, electrically powered pump means carried on the upper end of said probe for delivery of pressurized air down the second passage, said electrically powered pump means comprising an electrically powered motor operatively coupled to an air pump having an output port thereon and a tube coupling said output port to said second passage.

9. The keg pump assembly of claim 8 wherein said motor is a 12 VDC motor.

10. The keg pump assembly of claim 8 wherein said output port is further coupled to a pressure regulator, said pressure regulator is operable to detect air pressure levels in said tube, said pressure regulator is electrically coupled to said motor, said pressure regulator selectively interrupts electric coupling to said motor whenever a predetermined air pressure in said tube is detected.

11. The keg pump assembly of claim 8 wherein said pump means is surrounded by a housing, said housing has an opening therethrough, an electric plug is mounted within said opening, said electric plug is selectively electrically coupled to a 12 VDC electrical source.

12. The keg pump assembly of claim 11 wherein said 12 VDC electric source is a 12 VDC battery pack.

13. The keg pump assembly of claim 11 wherein said 12 VDC electric source is a 110 VAC to 12 VDC converter.

14. The keg pump assembly of claim 8 wherein said air pump delivers at least one liter of air per minute at 4±2 pounds per square inch.

15. The keg pump assembly of claim 10 wherein said pressure regulator selectively interrupts said electric coupling to said motor when pressure in said ducts exceeding approximately 6 psi is detected by said pressure regulator.

16. A powered pumping adapter for modification of a manually operated keg tapping valve apparatus provided with a vertically disposed reciprocating hand pump upon the top thereof, the manually operated keg tapping valve apparatus matable with a beer keg having a bayonet fitting and having a down tube therein with a spring biased valve opening into the down tube of the keg, the keg tapping valve apparatus further comprising a valve body having an air passageway therethrough and a liquid passageway therethrough isolated from said air passageway, said liquid passageway communicative with the opening of said keg down tube when said beer keg tapping valve is operatively coupled with said keg fitting, the keg tapping valve apparatus having had removed therefrom the reciprocating hand pump, comprising an adapter member mountable to the top of the keg tapping valve apparatus, the adapter member having an opening therethrough, the opening through said adapter member in substantial alignment with said air passageway through said valve body, a nipple mounted within said opening of said adapter plate, said nipple having a passageway therethrough in communication with said air passageway of said valve body, a pumping assembly disposed upon said adapter plate, said pumping assembly comprising an electric motor and an air pump, the air pump having an output port coupled to said nipple of said adapter member by a first duct, said motor electrically coupled to a source of electric power.

17. The powered pumping adapter of claim 16 wherein a pressure regulator is coupled to said output port of said air pump by a second duct, said pressure regulator operative to detect air pressure in said second duct, said pressure regulator is electrically coupled to said motor, said pressure regulator is preset to interrupt said electric coupling between said motor and said electric source as long as a predetermined air pressure in said second duct is present.

18. The powered pumping adapter of claim 16 wherein said electric motor is a 12 VDC motor, said motor is selectively coupled to a 12 VDC electrical source.

19. The powered pumping adapter of claim 16 wherein said air pump delivers at least one liter of air per minute at 4±2 pounds per square inch.

20. The powered pumping adapter of claim 17 wherein said pressure regulator selectively interrupts said electric coupling to said motor when pressure in said ducts exceeds approximately six pounds per square inch.

* * * * *